US007753241B2

(12) United States Patent
Masanek, Jr.

(10) Patent No.: US 7,753,241 B2
(45) Date of Patent: Jul. 13, 2010

(54) HANGER WITH DOUBLE RATCHETING SLIDING-JAW CLAMPS

(75) Inventor: Frederick W. Masanek, Jr., Barrington, IL (US)

(73) Assignee: MacNeil IP LLC, Downers Grove, IL (US)

( * ) Notice: Subject to any disclaimer, the term of this patent is extended or adjusted under 35 U.S.C. 154(b) by 87 days.

(21) Appl. No.: 12/140,419

(22) Filed: Jun. 17, 2008

(65) Prior Publication Data

US 2009/0308899 A1 Dec. 17, 2009

(51) Int. Cl.
*A41D 27/22* (2006.01)

(52) U.S. Cl. ..... 223/91; 223/85; 223/96; 211/45; 211/113

(58) Field of Classification Search ..... 223/85, 223/90, 91, 93, 96, DIG. 2; 211/45, 113
See application file for complete search history.

(56) References Cited

U.S. PATENT DOCUMENTS

| | | | | |
|---|---|---|---|---|
| 3,558,038 | A | 1/1971 | Gelles et al. | |
| 3,698,043 | A | 10/1972 | Batts | |
| 3,698,607 | A | 10/1972 | Batts | |
| 3,745,616 | A | 7/1973 | Batts | |
| 3,841,478 | A | 10/1974 | Wells et al. | |
| D235,316 | S | 6/1975 | Wells | |
| 4,034,903 | A * | 7/1977 | Batts | 223/96 |
| 4,054,234 | A | 10/1977 | Thomas | |
| 4,236,280 | A | 12/1980 | Kreiseder | |
| D287,085 | S | 12/1986 | Leeds | |
| 4,856,654 | A | 8/1989 | Reuben | |
| 5,027,480 | A | 7/1991 | Hogarth | |
| D323,587 | S | 2/1992 | Primeau | |
| 5,178,306 | A | 1/1993 | Petrou | |
| 5,257,694 | A | 11/1993 | Wallach | |
| 5,350,092 | A | 9/1994 | Hollis | |

(Continued)

FOREIGN PATENT DOCUMENTS

CA 1063801 A2 10/1979

(Continued)

OTHER PUBLICATIONS

British Patent Office, Combined Search and Examination Report of Application No. GB0815630.9, Oct. 30, 2008.

(Continued)

*Primary Examiner*—Gary L Welch
*Assistant Examiner*—Nathan E Durham
(74) *Attorney, Agent, or Firm*—Momkus McCluskey, LLC; Jefferson Perkins; Steven Behnken

(57) ABSTRACT

A hanger for suspending multiple articles, such as automotive floor mats, is injection-molded in one piece from a suitable polymer. The hanger has at least four stationary article gripping members and four mobile article gripping members which are fastenable to respective ones of the stationary gripping members. Article-supporting fingers of the stationary gripping members extend horizontally away from the hanger body, two in one direction and two in another. The stationary gripping members are arranged in pairs, with one member in a pair extending in one direction, and the other member of the pair extending in an opposite direction. In one embodiment, a shared structural plate makes up a portion of the "C" channel for each gripping member in the pair.

12 Claims, 15 Drawing Sheets

U.S. PATENT DOCUMENTS

| | | | |
|---|---|---|---|
| 5,397,038 | A | 3/1995 | Hunt |
| 5,657,518 | A | 8/1997 | Hunt |
| 5,957,345 | A | 9/1999 | Petrou et al. |
| 6,065,652 | A | 5/2000 | Dooling-Sherman |
| 6,182,870 | B1 | 2/2001 | Seissler |
| 6,226,839 | B1 | 5/2001 | Sayegh |
| D475,283 | S | 6/2003 | Haboush |
| D519,157 | S | 4/2006 | Balatti |
| D525,661 | S | 7/2006 | Hussaini et al. |
| 2007/0145085 | A1 | 6/2007 | Masanek, Jr. |

FOREIGN PATENT DOCUMENTS

| | | | |
|---|---|---|---|
| DE | 8703708 | U1 | 6/1987 |
| DE | 29907308 | U | 7/1999 |
| GB | 2205488 | A | 12/1988 |
| GB | 2447999 | A | 10/2008 |
| JP | 2005144012 | A | 6/2005 |
| WO | WO9417706 | | 8/1994 |

OTHER PUBLICATIONS

Photographs taken Apr. 2, 2007, All Weather Floor Mat Hanger manufactured for Hyundai.

British Patent Office, Search Report of GB Appln. GB0715041.0, Nov. 30, 2007.

British Intellectual Property Office, Combined Search and Examination Report on Application No. GB0905277.0 dated Jul. 22, 2009.

German Patent Office, Office Action on Application No. 102007042728.1-16 dated May 6, 2009.

Canadian Intellectual Property Office, Requisition by the Examiner on Application No. 2,594,050 dated Jan. 29, 2009.

European Patent Office, Search Report on European Patent Application No. 08252867.0, dated Oct. 2. 2009.

* cited by examiner

HANGER WITH DOUBLE RATCHETING SLIDING-JAW CLAMPS

BACKGROUND OF THE INVENTION

Vehicle floor mats and like articles are conveniently displayed at a point of sale by being hung on hangers from a display rack. The floor mats can be fairly heavy, more so than most garments taking up the same space, are typically flat and are flexible. Hangers for suspending these floor mats therefore have to be substantial enough to indefinitely sustain their weight without failure, and must secure the suspended mats well enough that they don't become separated even when subjected to considerable shearing or torsional forces experienced during shipping or display.

It is to the manufacturer's commercial advantage if such hangers can be easily attached to the mats before they are shipped to distributors. Where made of plastic, such hangers should be easily injection-molded. The inventor has developed a hanger which satisfy these characteristics (see US Patent Application Publication No. 2007 US 0145065 A1, assigned to the Assignee hereof). Additional savings could be obtained if more articles were suspended from one hanger.

SUMMARY OF THE INVENTION

According to one aspect of the invention, a hanger for suspending a plurality of articles has a hook or the like for suspending the hanger from a bar, and a crosspiece joined to and disposed below the hook. The crosspiece extends horizontally from a vertical axis running through the bar hook in a first direction and in a second direction opposed to the first direction, at least as far as respective first and second locations on the crosspiece which are equidistant from the vertical axis. The hanger is provided with at least four pairs of gripping members meant to suspend the articles. Each of the pairs has a stationary gripping member affixed to the crosspiece and a mobile gripping member. A first stationary gripping member is disposed at the first location and extends horizontally in a third direction at an angle to the first and second directions. A second stationary gripping member is disposed to be adjacent to the first stationary gripping member but horizontally projects in a fourth direction opposite the third direction. A third stationary gripping member is disposed at the second location on the crosspiece and horizontally extends in the third direction. A fourth stationary gripping member is disposed to be adjacent to the third stationary gripping member and horizontally extends from the crosspiece in the fourth direction.

For each stationary gripping member, a mobile gripping member is provided which, in combination with the stationary gripping member, will capture at least one (and preferably two) articles therebetween. The mobile gripping member is provided with a fastener to releasably fasten it to the stationary gripping member to thereby secure the articles being suspended. The disposition of the first, second, third and fourth stationary gripping members is such that any shear or bending moment resulting from the downward force created by one suspended article will tend to be balanced out by like forces created by another suspended article on the other side of the crosspiece.

According to another aspect of the invention, each stationary gripping member is formed as a "C" channel from three plates. First and third spaced-apart ones of these plates occupy vertical planes parallel to the third direction as above defined. The second plate joins these two together, spaces them apart and is at right angles to the first and third plates.

The third plate of one such stationary gripping member is continuous and coplanar with the third plate of an adjacent one of the stationary gripping members—providing enhanced resistance to any bending moment created by the suspended articles.

Preferably, both the stationary and mobile gripping members of each pair are furnished with opposed, inwardly-directed article supporting fingers. It is preferred to fasten each mobile gripping member to a stationary gripping member by means of an array of ratcheting teeth present on a fastening arm of the mobile gripping member, and a detenting pawl associated with the stationary gripping member. Each pawl is conveniently provided with a tab or lever which, when pressed by a thumb or finger, rotates as a unit with the pawl, moving teeth of the pawl out of engagement with the teeth on the fastening arm, and permitting the withdrawal of the mobile gripping member from the hanger body.

In a particularly preferred embodiment, pairs of fastening arm-receiving channels or orifices are formed in the crosspiece at each of the first and second locations, each channel receiving a fastening arm of a respective mobile gripping member. A back plate forming a portion of one such channel also forms a portion of an adjacent channel.

One technical advantage of the present invention is its ease of molding and assembly to the suspended article in comparison with prior art designs. Another is the resistance of the invention to inadvertent detachment of the suspended article from the hanger during shipment or display. A third technical advantage is the ability to suspend a larger plurality (such as four) heavy articles such as vehicle floor mats from a single hanger, in a balanced fashion.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
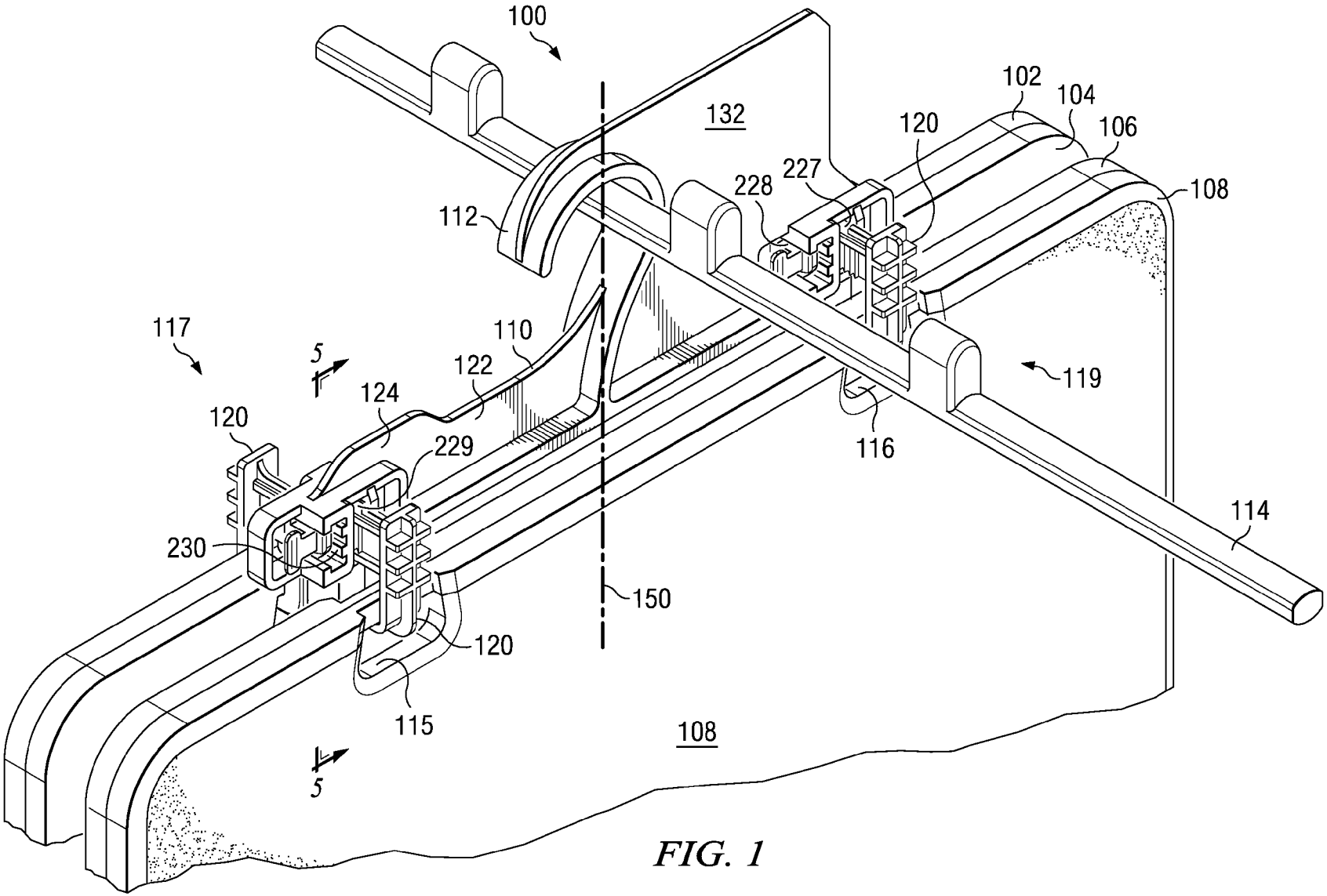
FIG. 1 is an isometric view of a commercial embodiment of the invention, shown suspending two pairs of vehicle floor mats from a display rack arm.

A commercial embodiment 100 of a hanger according to the invention is shown in FIG. 1, as suspending two pairs of vehicle floor mats 102, 104 and 106, 108. Mats 102-108 may, for example, be a set of four custom-fitted mats for a vehicle with front and rear seats. The hanger 100 has a preferably injection-molded body 110 with an upstanding hook 112 from which the hanger and mats 100, 102-108 can be suspended from a bar 114 of a display rack or the like. The illustrated embodiment is particularly designed to suspend two pairs vehicle floor mats 102, 104; 106, 108 each in a back-to-back condition, where in a pair of molded indentations 115, 116 near the upper margin of a front-facing floor mat 108 face frontwardly, and a similar pair of indentations (one such seen in FIG. 5) in floor mat 106 face rearwardly. Similarly, four such indentations appear near the top margins of the other mat pair 102, 104, two indentations per mat, with two facing forwardly and two facing rearwardly. The hanger 100 preferably grips each mat 102-108 at two spaced locations 117, 119 which are horizontally spaced from bar 114 in such a way that the mats 102-108 will hang squarely relative to the floor. Locations 117, 119 are equidistant from a center line 150 of the hanger 100. In other embodiments of the invention, the hanger 100 could have more than two gripping locations per mat or suspended article, or only one of them.

Figure 2:
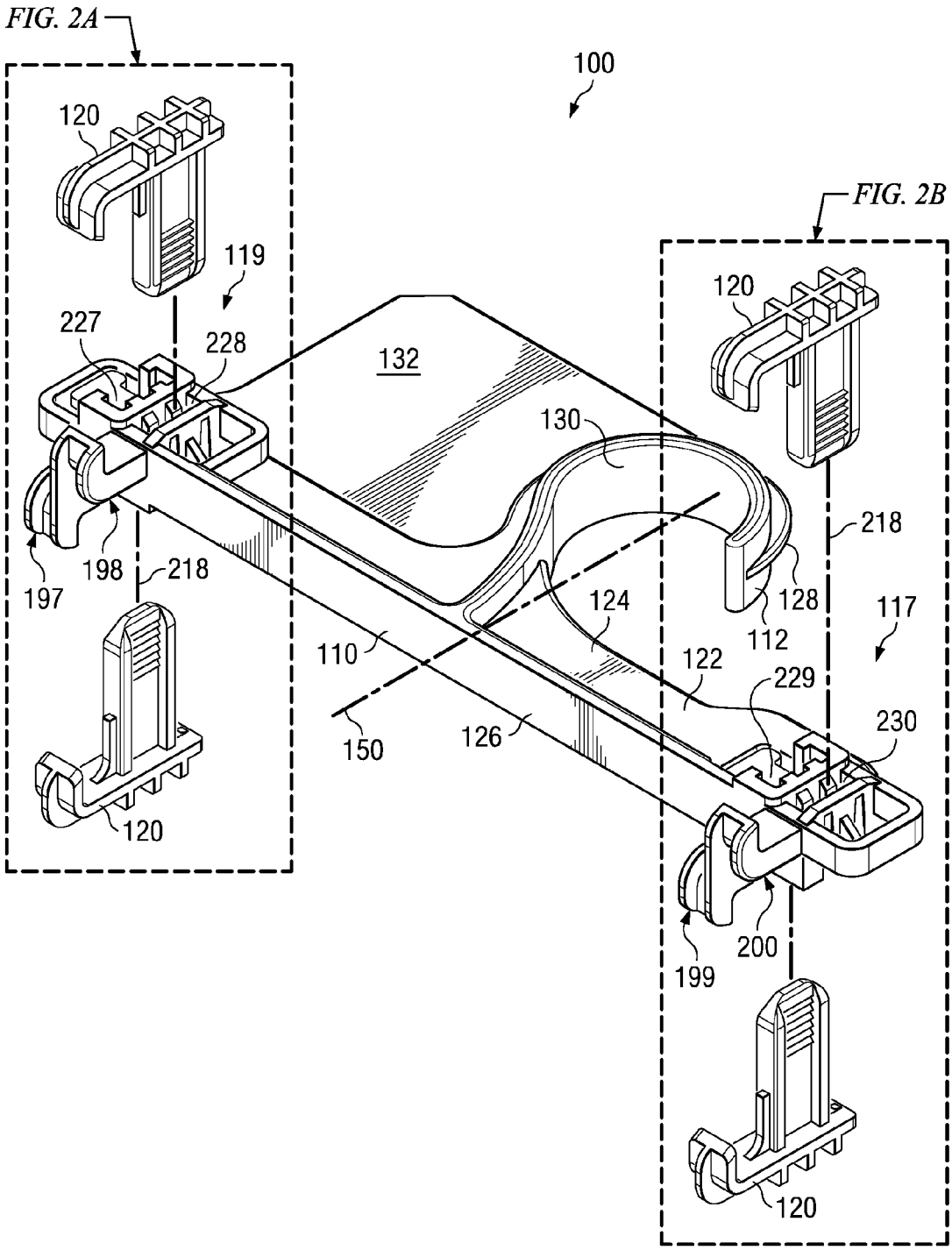
FIG. 2 is an exploded isometric view of the hanger shown in FIG. 1.
Figure 3:
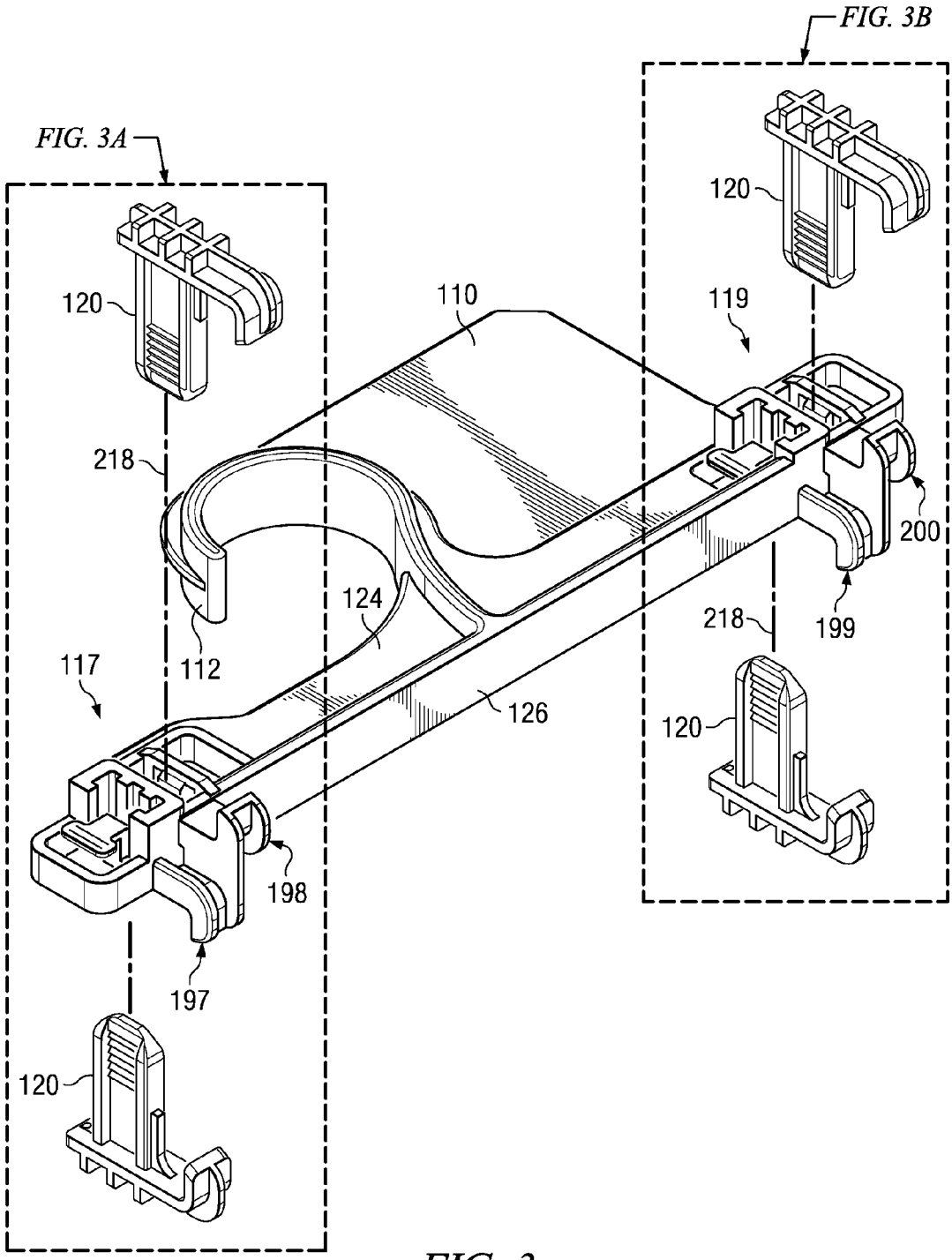
FIG. 3 is an exploded isometric view of the hanger shown in FIG. 1, taken from a reverse side.
Figure 4:
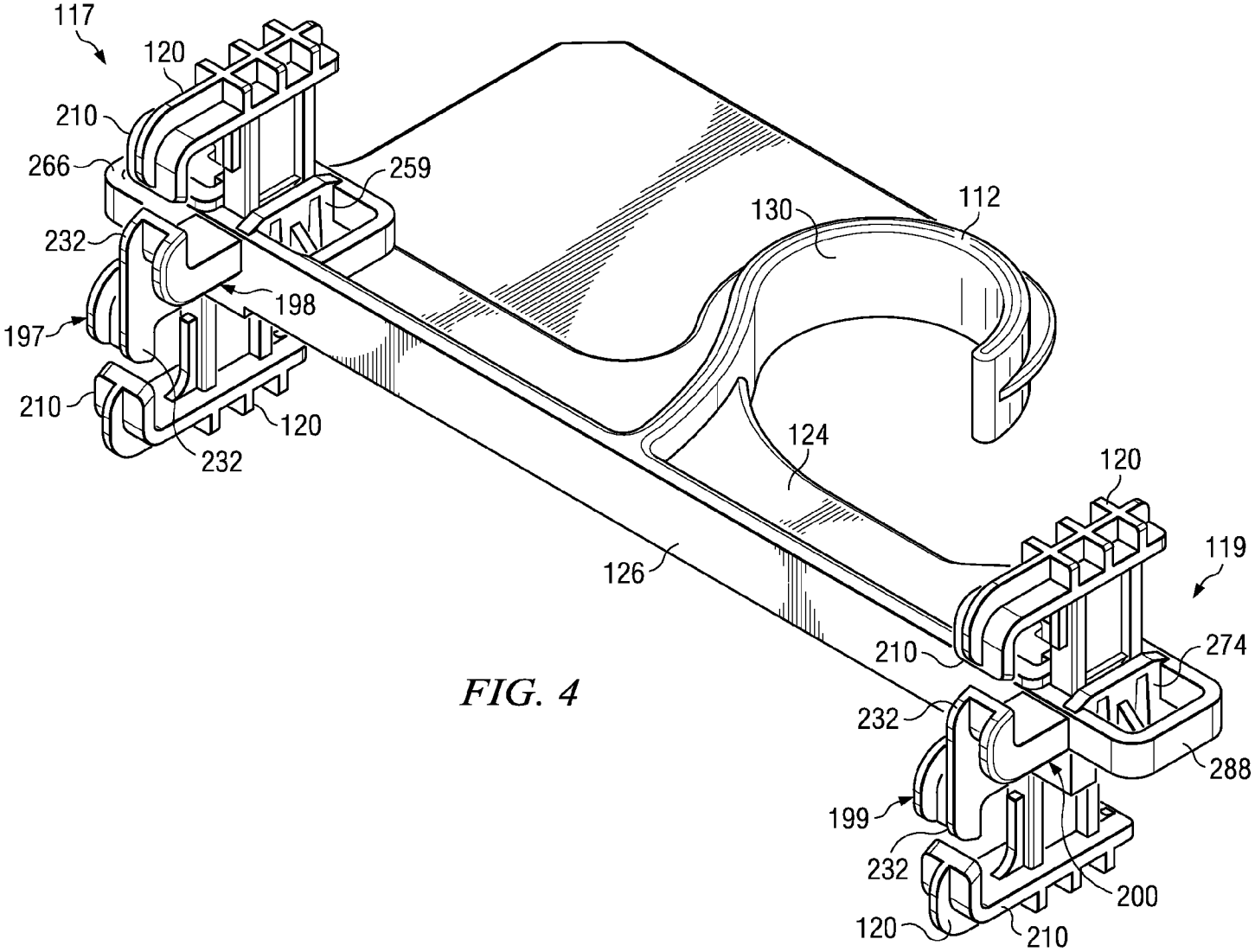
FIG. 4 is an isometric view of the hanger shown in FIG. 1, in a closed or fastening condition.

Referring to FIGS. 2-4, the hanger 100 further includes a number of mobile gripping members or claws 120 which in use are separate from and can be inserted into and withdrawn from the body 110. The hanger 100 is conveniently injection-molded from a tough plastic such as ABS. The hook 112 and crosspiece 122 of the body 110 are each formed of vertical and horizontal plates for strength and resistance to tension, shear and torsion forces. The crosspiece 122 has a plate 124 which in use is vertical, and a horizontal plate 126 formed at a lower margin thereof. The bar hook 112 is formed from a vertical plate 128 which is an integral extension of the vertical crosspiece plate 124, and joined to this a lateral plate 130 which also acts a surface contacting the display rack bar 114. The body 110 further has a flag 132 which is an extension of the crosspiece plate 124 and which further is continuous with the hook plate 128, providing lateral reinforcement thereto. The flag 132 provides an area to which a product label or other printed matter may be conveniently printed or adhered.

Crosspiece 122 extends horizontally in each of two directions from vertical axis 150. Crosspiece 122 extends at least far enough to incorporate first and second spaced-apart locations 117, 119 at which mats 102-108 are gripped. For each article gripping or supporting location 117, 119, a pair of gripping members per mat is provided: a mobile gripping member 120 and one of four stationary gripping members or claws 197, 198, 199 or 200 each which preferably is integrally formed as a portion of the body 110.

Figure 2A:
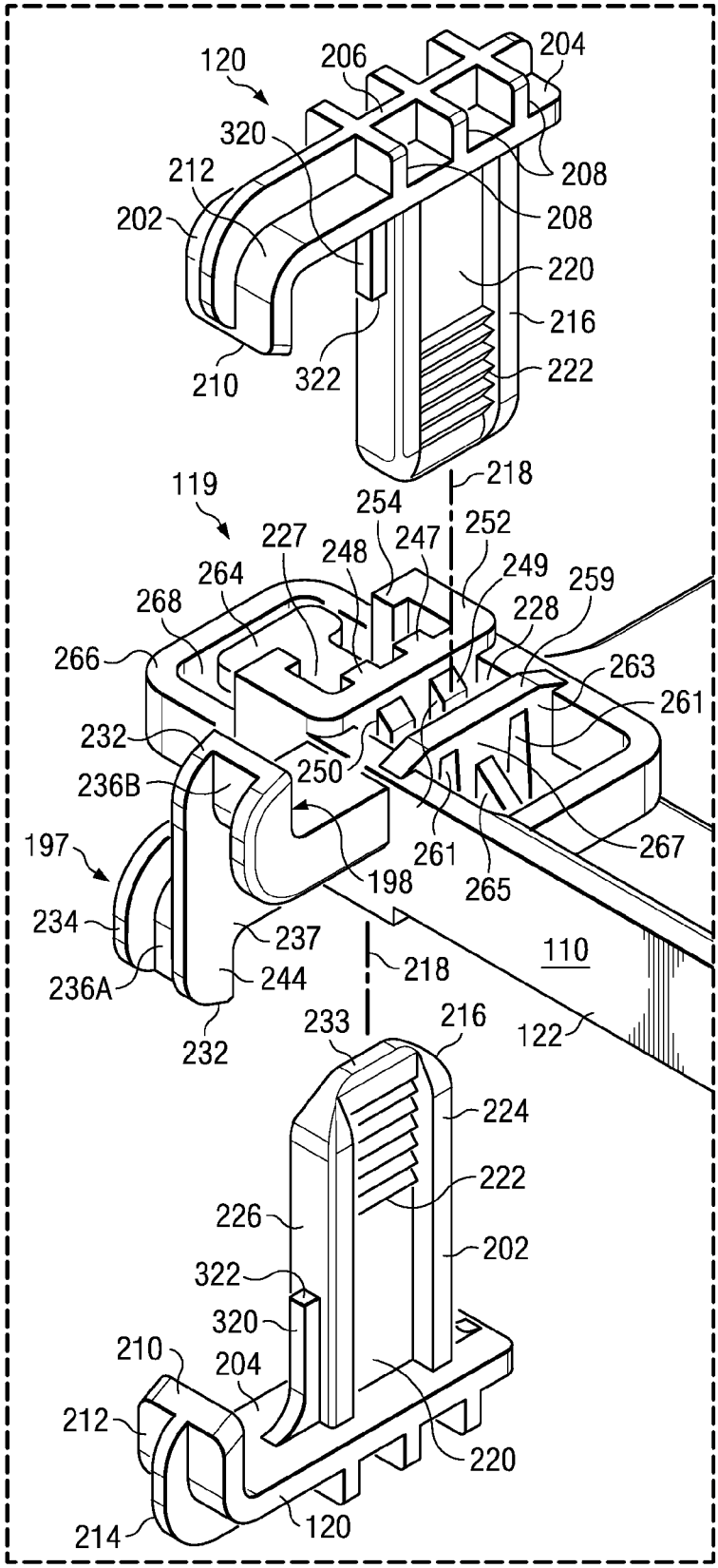
FIGS. 2A and 2B are details of the ends of the hanger shown in FIG. 2.

As seen for example in FIG. 2A, each mobile gripping member 120 has a body 202 comprising a vertical plate 204 and preferably a single central reinforcing plate 206 which extends from plate 204 at right angles thereto and in use is vertical. The body 202 further may have horizontally disposed plates 208, which are integrally formed with, stand at right angles to, and intersect vertical plates 204 and 206. Plates 208 provide additional surface area for contact by a thumb or finger of a user when the user desires to push a mobile gripping member 120 into one of the hanger channels 227-230 (described below). Plates 208 also add an element of reinforcement.

A lower end of the body 202 preferably has a horizontally and inwardly projecting process or article support finger 210. The support finger 210 is formed in this embodiment as a curved extension 212 of plate 204 and is reinforced along its back with a curved extension 214 of plate 206.

In the illustrated embodiment the mobile gripping member 120 has a fastening arm 216 which extends in a direction of translation 218 relative to the body 110 of hanger 100; preferably, this direction 218 is horizontal and is at right angles to axis 150 (see FIG. 2) and to the vertical plane to which hanger 100 (and supported articles 102-108) are aligned. The inwardly extending fingers 210 also conform to this direction 218. Preferably the fastening arm 216 has a height (in a vertical direction) which is greater than its width, to provide an optimum capacity to support the weight of the article suspended on finger 210.

The fastening arm 216 has at least one, preferably vertically disposed face 220 on which is formed an array of ratcheting teeth 222. The teeth 222 are spaced from each other in direction 218 and may extend between a horizontally disposed top fastening arm rail 224 and a horizontally disposed bottom fastening arm rail 226. Fastening arm rails 224, 226 are used to guide the fastening arm 216 into one of the channels or orifices 227, 228 (FIG. 2A), 229, 230 (FIG. 2B), each of which is associated with a respective one of the stationary gripping members 197-200. Preferably the fastening arm 216 terminates in a tapered nose 233 which aids in its insertion into one of the channels 227-230.

In a preferred embodiment, each mobile gripping member or clip 120 includes a pair of ribs 320 (seen in FIG. 2A) and 324 (seen in FIG. 5) on the lower and upper surfaces of fastening arm 216, respectively. Ribs 320 and 324 extend laterally inwardly from plate 204, but terminate at their respective inner ends 322, 326 well before the fastening arm nose 233, and preferably before the first ratcheting tooth 222. In an alternative embodiment, the ends or stops 322, 326 could be surfaces on upstanding and downwardly depending bumps, respectively, which do not extend from plate 204 but which are spaced therefrom. An elongate rib is preferred for its strengthening characteristics.

The present four-mat hanger differs from the Applicant's prior version (see U.S. Patent Application Publication No. 2007 US 0145065 A1) in that, in the preferred, illustrated embodiment, the clips formed by mobile jaws 120 and stationary jaws or gripping members 197-200 are arranged in pairs which are in staggered relation to other pairs thereof. Further, the gripping members 120, 197-200 are, in use, farther away from a vertical central plane (occupied by plate 124) of the hanger 100. Without the ribs 320, 324, a person who is assembling a hanger to the mats which the hanger is designed to suspend could overdrive the mobile gripping member 120, as the fastening arm 116 of the gripping member 120 won't bottom out on the end of another fastening arm 116 of an opposed mobile gripping member 120, as happened in the prior version. This may cause the mobile gripping member 120 to fracture.

Figure 5:
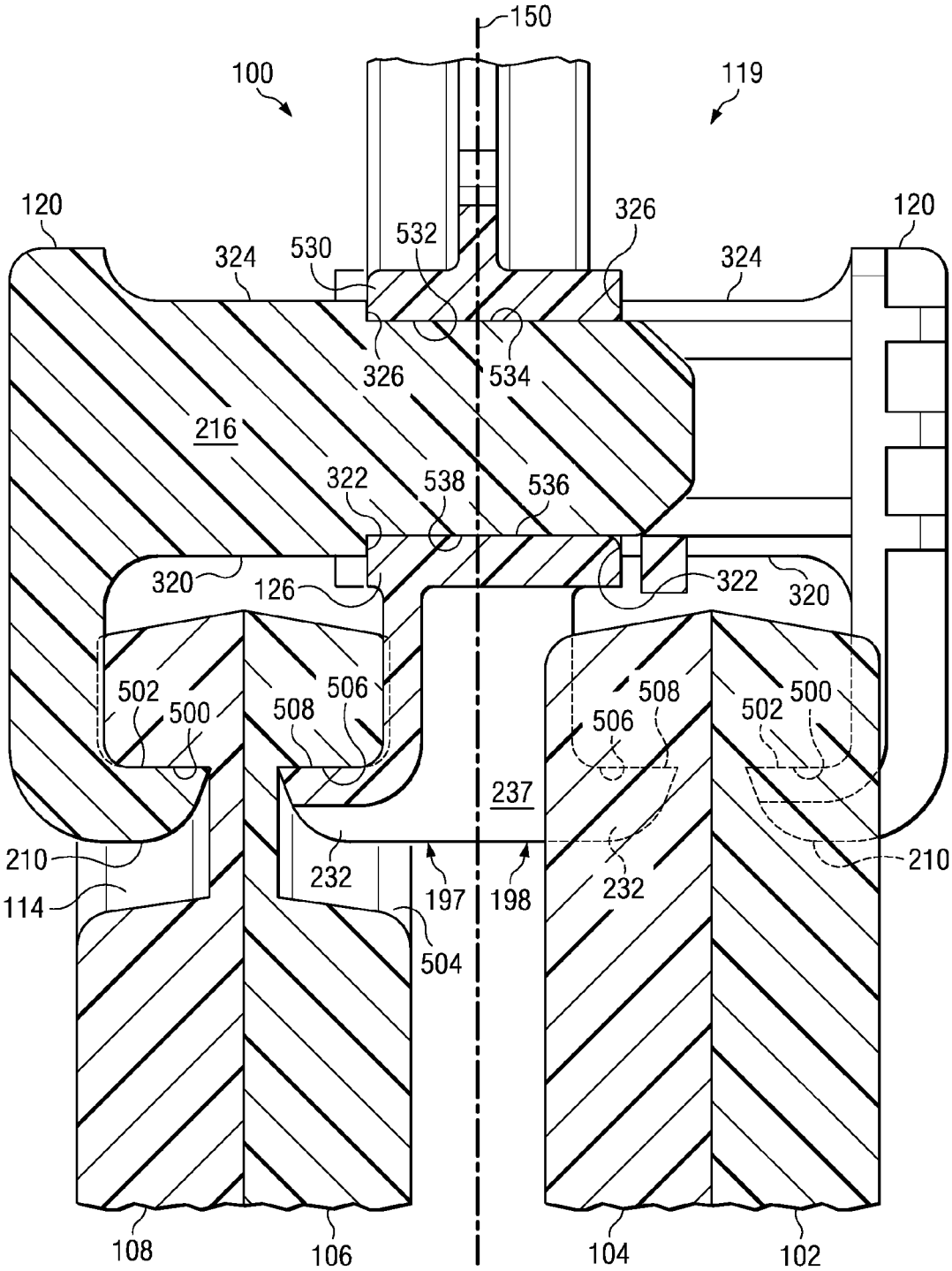
FIG. 5 is a sectional detail taken substantially along Line 5-5 of FIG. 1.

To keep this from happening, ribs 320, 324 have been added. Each rib 320, 324 presents a vertically disposed inner face 322 or 326 which acts as a stop against the respective lower or upper margins of a fastening-arm-receiving channel or orifice. If overdriven, the face 322 will com into contact with frame member 126, while face 326 will come into contact with channel-defining member 530 (FIG. 5). This physical interference will prevent the further inward insertion of the mobile gripping member 120.

Each stationary gripping member 197-200 is preferably integrally molded with hanger body 110 and downwardly depends therefrom. In the illustrated embodiment, a lower end of each stationary gripping member 197-200 terminates in an article support finger 232 which is disposed in parallel to direction 218 (here, horizontal) and extends laterally outwardly from crosspiece 122. A body 234 of each stationary gripping member 197-200 is preferably formed by a vertical plate 236A or 236B and two reinforcing vertical plates which are disposed at right angles to plate 236A or 236B, such that the body 234 has a "C" cross section.

Figure 2B:
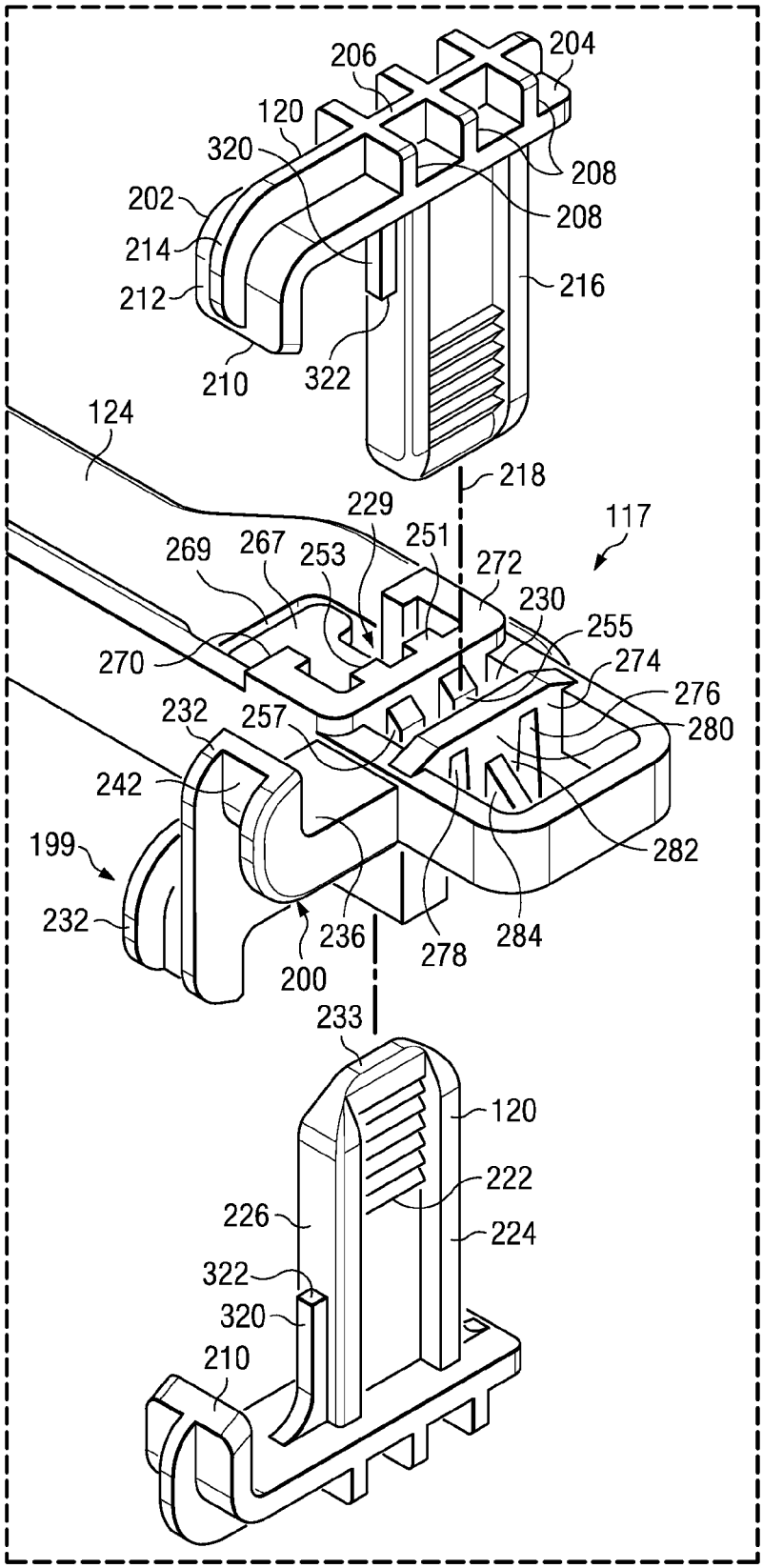
Figure 3A:
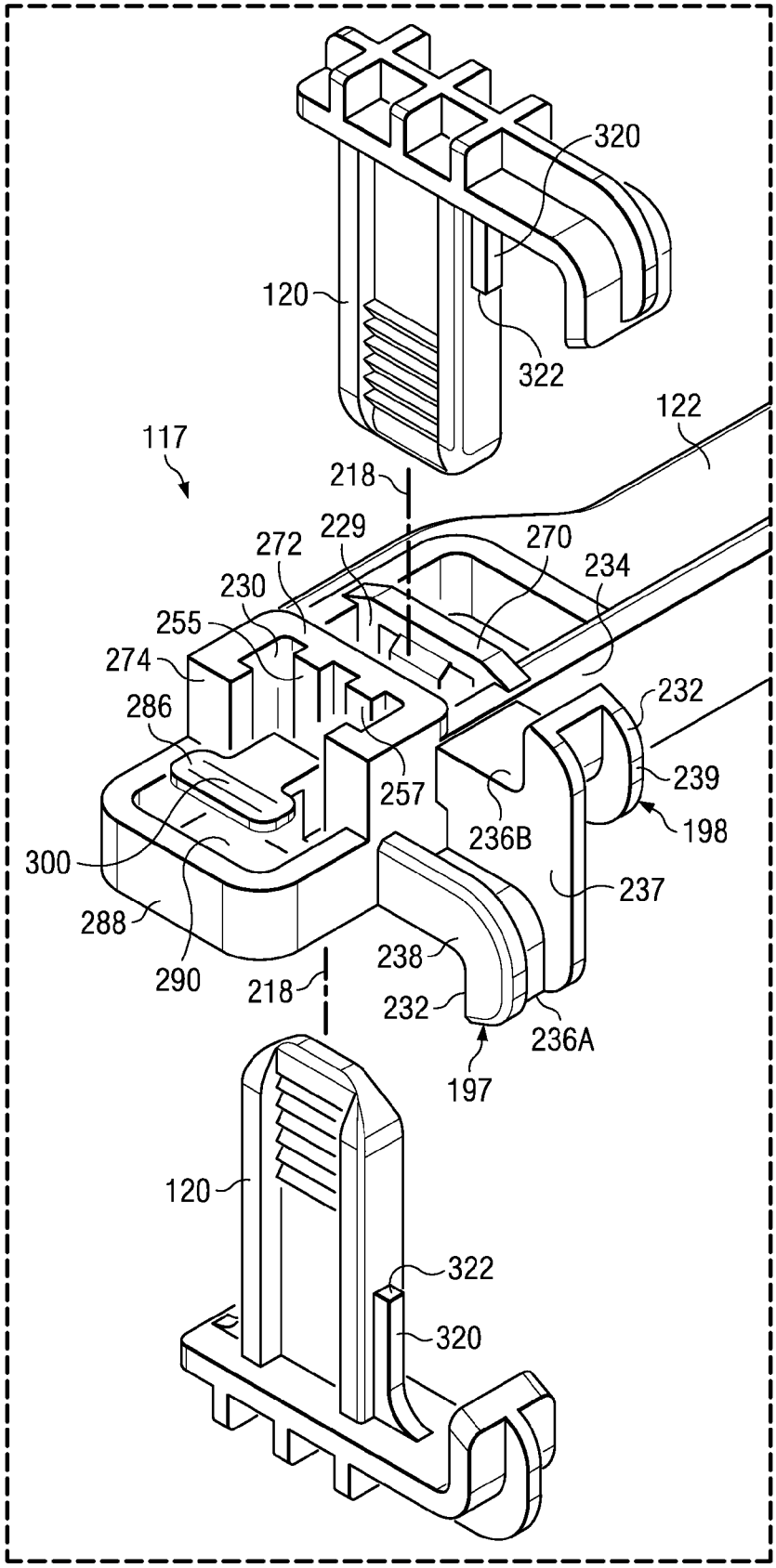
FIG. 3A is an isometric detail view of one end of a hanger crosspiece to show details of the stationary gripping members, fastening arm-receiving channels and related structure.
Figure 3B:
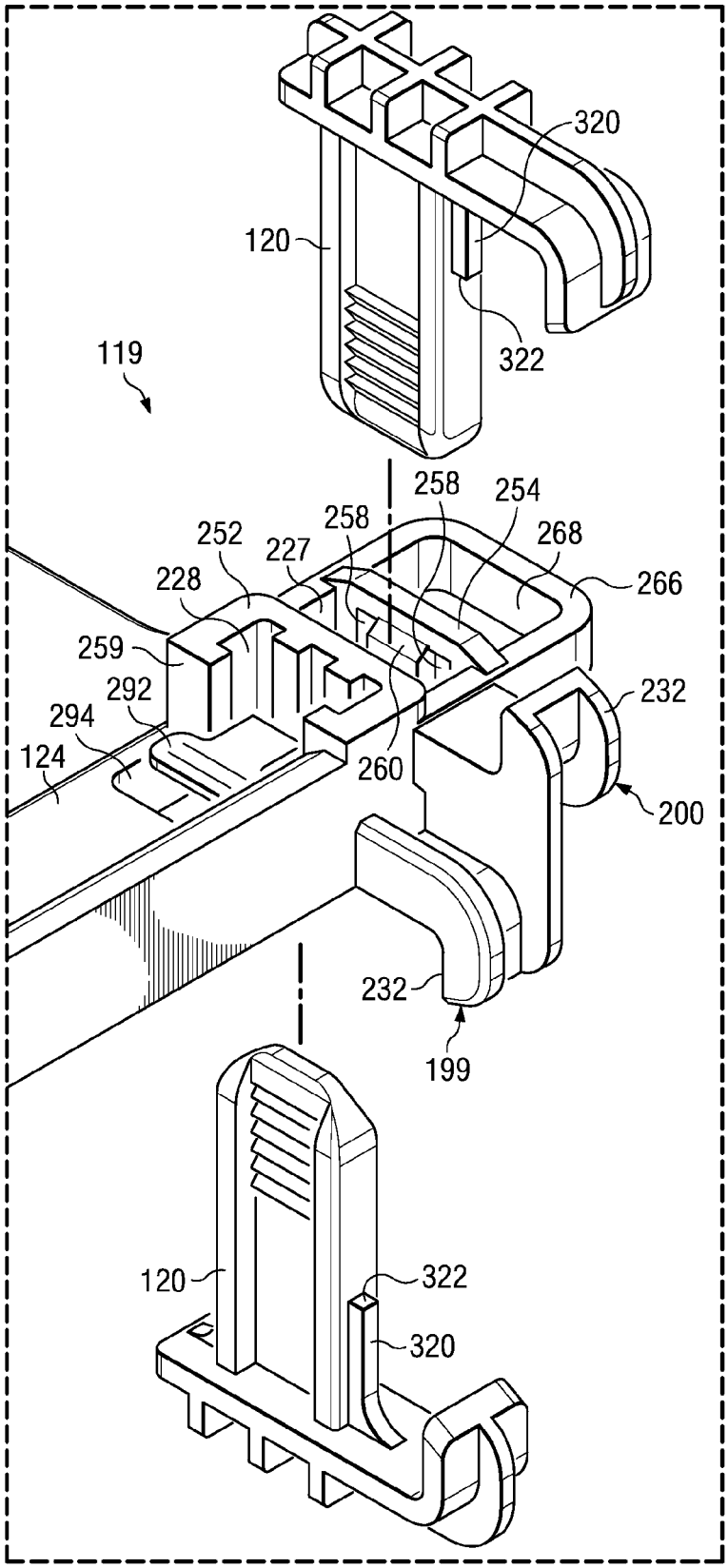
FIG. 3B is an isometric detail view of the other end of the hanger crosspiece shown in FIG. 3.
Figure 3C:
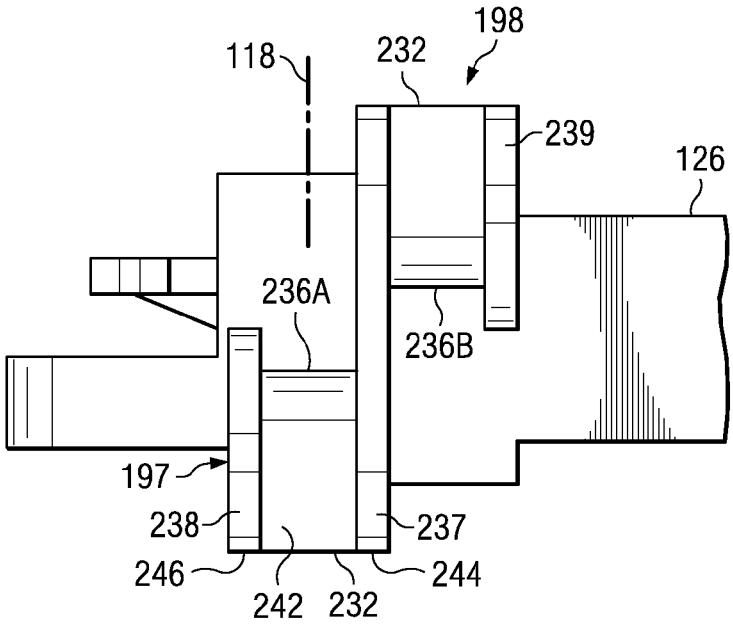
FIG. 3C is a detail from below of a pair of stationary gripping members according to the invention.

Stationary gripping members 197 and 198 (FIG. 2A) are formed as a closely associated pair at location 119, and stationary gripping members 199 and 200 (FIG. 2B) are formed as another closely associated pair at location 117. As is best seen in FIGS. 3A and 3B, and taking gripping member pair 197, 198 (FIG. 3A) as an example, each such associated pair shares a reinforcing plate 237 that forms portions of both "C" channels making up the pair 197, 198. Hence, gripping member 197 is formed of a laterally outward plate 238 that is vertically aligned and parallel to direction 218; joined to this, a plate 236A which begins as a vertical plate and which is orthogonal to the plate 238; and, joined to this in opposition to the plate 238, the shared plate 237, which is parallel to plate 238 and is at right angles to plate 236A.

Plate 237 extends in parallel to direction 118 to the other side of the hanger 100 to also form a portion of associated stationary gripping member 198. A plate 236B of member 198 extends from plate 237 laterally inwardly and at right angles to the plate 237. Plate 236B of member 198 terminates in a plate 239, which is orthogonal to plate 236B and parallel to plate 237. Plate 239 is spaced laterally inwardly from plate 237 by plate 236B of the stationary gripping member 198. In other words, the "C" channel of gripping member 197 is formed by a combination of plates 238, 236A and 237, while the "C" channel of gripping member 198 is formed by a combination of plates 237, 236B and 239.

Figure 3D:
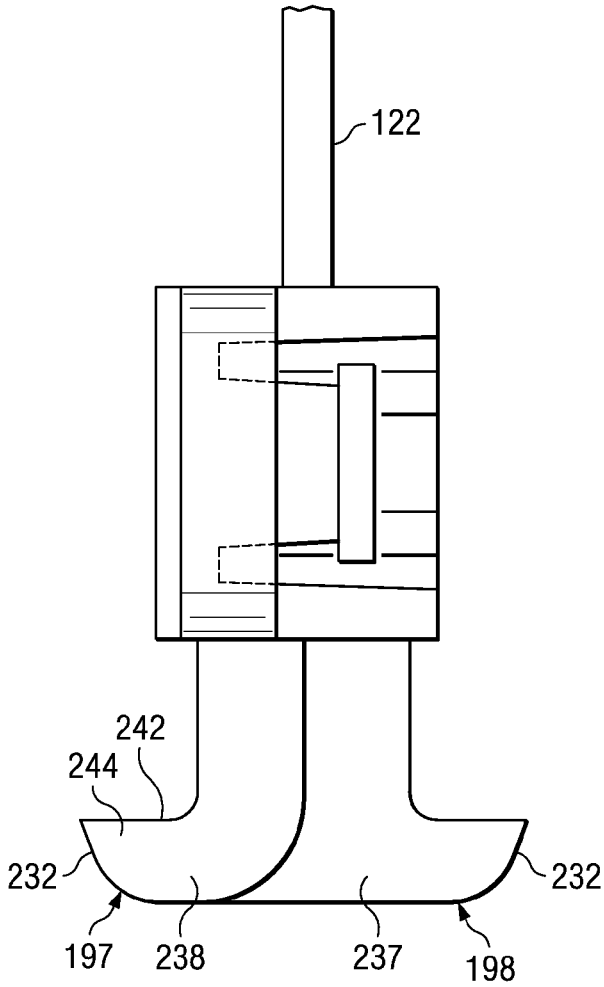
FIG. 3D is a detail end view of the pair of stationary gripping members shown in FIG. 3C.
Figure 3E:
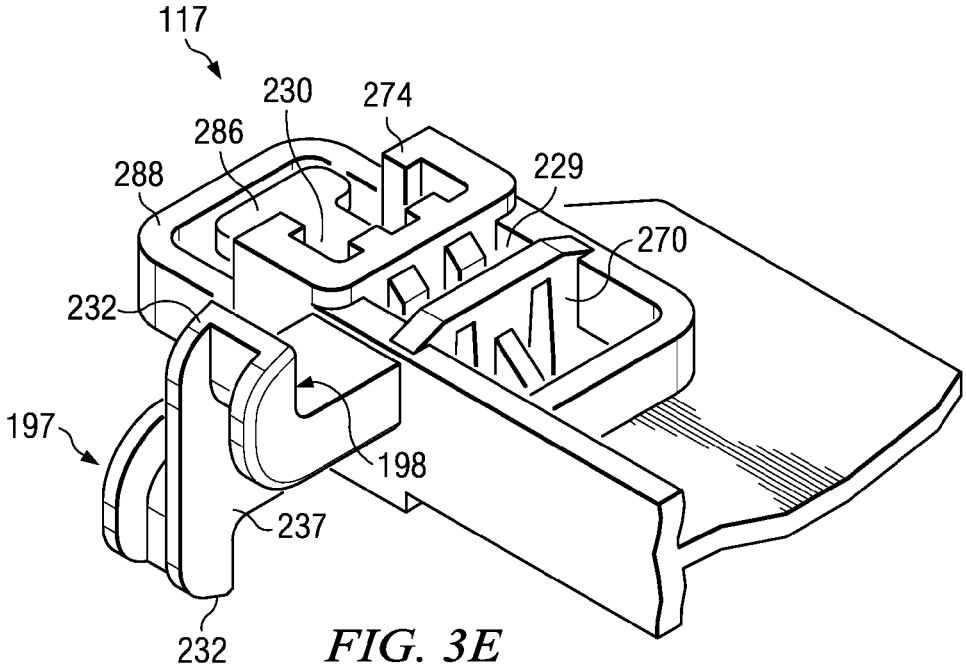
FIG. 3E is an isometric detail view of a pair of stationary gripping members at one end of the hanger shown in FIG. 3.
Figure 3F:
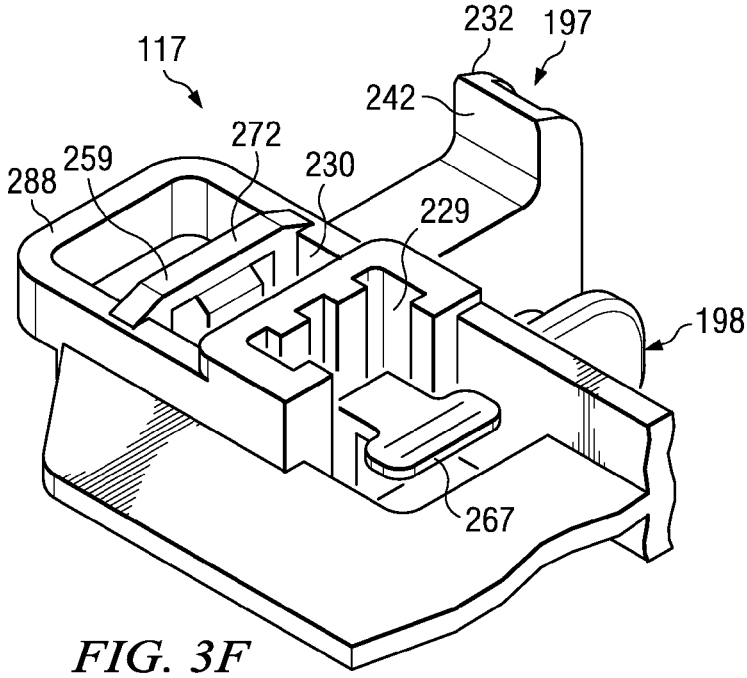
FIG. 3F is an isometric detail of the structure shown in FIG. 3E, from an opposite viewpoint.

Arranging the gripping members 197, 198; 199, 200 in pairs, such that each member in the pair extends in the opposite direction, provides technical advantages relative to balance and resistance to shear. FIG. 3D is an end view of an associated pair of gripping members 197, 198. As is illustrated in FIG. 5, downward force is exerted by a supported mat 106 on finger 232 of gripping member 197, while downward force is exerted by a supported mat 104 on finger 232 of opposed gripping member 198. Since these members are joined together by common reinforcing plate 237, any angular moment on one finger 232 around a point on axis 150 will be balanced out by the angular moment on the other finger 232, supposing fingers 232 to be equally loaded. Even if fingers 232 are not equally loaded, any load on one of the fingers 232 is going to be borne in part not only by the claw 197 or 198 of which finger 232 is a part, but by the other claw 197 or 198 as well. The members 197, 198 are thus mutually reinforcing.

To form support finger 232 and taking gripping member 197 as an example (see FIGS. 3C-3F), a curved extension 242 of the plate 236A is joined to curved extensions 244, 246 of the plates 237, 238. The plate extension 242 acts as a support surface on which the article 106 is suspended. In this embodiment, fingers 210, 232 are positioned to come together in opposition to each other, so as to capture two mats 106, 108 therebetween (see FIG. 5).

Channel or arm-receiving orifice 227 (see FIGS. 2A and 3B) preferably has a pair of elongate, parallel, spaced-apart glides 247, 248 which are formed in a channel back plate 252. Channel back plate 252 is preferably disposed in a vertical plane. Glides 247, 248 cooperate with fastening arm rails 224, 226 to better restrict the movement of mobile gripping member 120 to a direct translation down direction 218 into channel 227.

Channel 227 is also formed in part by a front plate 254, which is laterally outwardly spaced from plate 252 and is parallel to it. In fastening the articles 106, 108 to the hanger 100, the fastening arm 216 of the respective mobile gripping member 120 is inserted between front plate 254 and back plate 252. A pair of open-ended slots 258 are formed in the front plate 254 to leave a central section 260 which is connected only at one end to the rest of body 110. A triangular reinforcing gusset (see, e.g., similar gusset 265 provided for channel 228) projects orthogonally from the central section 260 and bridges from there to a manually operable tab or lever 264.

The back plate 252 serves as such for both the channel 227 and an adjacent channel 228, this last channel formed to be back-to-back with channel 227. The structure of channel 228 is a spatial translation of channel 227. A pair of parallel, spaced-apart glides 249, 250 are formed on the back plate 252 to extend laterally inwardly therefrom into channel 228. A plate 259 is positioned laterally inwardly of back plate 252 and helps define the channel 228. As is the case for plate 254, pair of parallel, open-ended slots 261 almost trisect the plate 259, leaving thin connecting portions at one end 263 thereof which will operate as a hinge. A triangular reinforcing gusset 265 projects orthogonally from the central section 267 of the plate 259 and bridges from there to another manually operable tab or lever 292 (FIG. 3B).

Channels 229 and 230 and associated structure are formed at the opposite location 117 on the crosspiece 122 and in mirror image to the channels 227 and 228. In FIG. 2B, there can be seen a tab or lever 267 associated with channel 229. The lever 267 is formed to have a surface which is substantially in the same plane as member 124 and occupies most of a space 269 in which it can articulate upon actuation of a finger. The lever 267 extends laterally inwardly and orthogonally from a plate 270 (see also FIG. 3A), this last plate forming one side of the channel 229. A plate 272, parallel to plate 270, serves as a back plate for both channel 229 and adjacent channel 230. The back plate 272 serves as the structural support for two parallel glides 251, 253 which protrude into channel 229, and two such parallel glides 255, 257 which extend from an opposite side and in an opposite direction into channel 230.

A plate 274 is laterally outwardly displaced from back plate 272 and is parallel to it. Plate 274 helps define the channel 230. Like plates 254, 259 and 270, this plate 274 is almost trisected by a pair of parallel open-ended slots 276, 278 to form a hinge 280 at the non-divided end thereof, and defining a central section 282. A triangular reinforcing gusset 284 is orthogonal to the central section 282 and bridges between that central plate section and a tab or lever 286 (FIG. 3A) for the channel 230.

FIG. 3 and its details FIGS. 3A and 3B are isometric views from a direction opposite from that shown in FIGS. 2, 2A and 2B, and show some of the structure hidden in FIGS. 2, 2A and 2B. The channel 230 is furnished with a tab or lever 286. This lever 286 projects laterally outwardly from the central section 282 of channel plate 274. It is preferred that tab 286, and the other three tabs similar to it, occupy vertical planes. The lever or tab 286 is depressable in a horizontal direction, which is downward in FIGS. 3 and 3A. In the illustrated embodiment this direction happens to be parallel to the direction 218 of mobile gripping member translation.

The crosspiece 122 of the body 110 terminates at end or location 117 with a guard 288 having an orifice 290 into which tab 286 can be depressed. The guard 288 is disposed in a plane which is orthogonal to the direction of actuation of lever 286. Guard 288 helps guard against inadvertent actuation of the tab or lever 286, and also provides an anchor or leverage or purchase point for a thumb or finger when a user manually presses in lever 286. Tab 286 may terminate in an enlargement 300 which provides more surface area for a thumb or finger to engage.

With reference back to FIG. 2B, tab 267, associated with channel 229, is formed to extend in an opposite, laterally inward direction from the common back plate 272, and into an orifice 269 made in member 124 so that tab 267 can be accessed by a finger and depressed downwardly (as seen in FIG. 2; this is a direction opposite to the direction in which tab 286 may be depressed).

The mirror-image tab structure is repeated at the other end or article-suspending location 119. A tab 292 (FIG. 3B) is provided for channel 228 and may be depressed downwardly (as seen in FIG. 3B) into laterally inwardly-extending orifice 294, orifice 294 being made through vertical cross piece member 124. The tab 264 for channel 227 (see FIG. 2A) is guarded by an end guard 266, which creates and defines an orifice 268 in which the tab 264 may be depressed upwardly (as seen in FIG. 2A). The guard 266 is similar in form and function to guard 288 at end or location 117.

FIG. 4 is an isometric view similar to FIG. 2, but showing the mobile gripping members 120 completely inserted into channels 227-230 (see FIG. 2) to closed or fastening positions. FIG. 4 shows the spatial relationship between article supporting fingers 210, 232 when the finger pairs 120, 197; 120, 198; 120, 199 and 120, 200 are in a closed position relative to each other. The ends of fingers 210, 232 continue to be spaced apart from each other by a distance which is a little less than twice the thickness of two suspended articles.

FIG. 5 is a sectional detail at location 119, showing the relationship of a mobile gripping member 120 when the fastening arm 216 thereof has been inserted to a closed position in orifice or channel 227. Finger 210 has been inserted all the way into indentation 114 of the mat or other suspended article 108. A surface 500 of the mat indentation 114 will rest upon a top surface 502 of the article support finger 210. Similarly, article support finger 232 is now disposed inside of a preformed indentation 504 built into mat 106 for the purpose of being suspended by hanger 100. A surface 506 of the indentation 504 will rest upon a top surface 508 of the stationary article support finger 232. Fingers 210, 232 thereby capture between them two back-to-back mats 106, 108.

This structure is repeated on the right side of FIG. 5, where, in another, laterally inwardly disposed plane parallel to the paper, a mobile gripping member 120 has been inserted into an adjacent channel 228 (seen, e.g., in FIG. 2). The channel 228 has a stationary gripping member 198 associated with it, while channel 227 has a stationary gripping member 197 associated with it. A plate 510 is common to both stationary gripping members 197, 198.

The mats 108, 106; 104, 102 are hung in such a fashion that each pair of them is equidistant to a center line 150 of the hanger 100. The weight of mats 108, 106 will have a tendency to cause stationary gripping member 197 and associated structure to deflect downward and rightward to the center line 150. However the weight of mats 104, 102 will have a tendency to cause stationary gripping member 198 and associated structure to deflect downward and leftward toward centerline 150. The leftward and rightward force vectors will cancel out through shared plate 237. The combined structure can therefore bear more weight than either stationary gripping member 199, 200 acting alone.

Where the suspended article(s) have some elastic give to them, as e.g. rubber vehicle floor mats are because they are fabricated of an elastomer, it is preferred that when the gripping members 120, 197-200 are in a completely closed or latched position, they hold the article(s) 108, 106 and 104, 102 in a slightly compressed condition. Then, when the user presses one of levers 264, 267, 286 or 292, the respective mobile gripping member 120 will "pop" outward from stationary member 200 in parallel to direction 218. The "pop" motion of the mobile member 120 will visually identify the member 120 to the user as the component which should be withdrawn from the remainder of hanger 100 in order to remove the article 102, 104, 106 or 108 from the hanger 100. The "pop" motion also automatically starts this withdrawing action and makes it easier for a user to complete it.

The channel or orifice 227 associated with stationary gripping member 197 is defined in part by a top frame member 530 and crosspiece frame member 126. A bottom surface 532 of the top frame member 530 adjoins a top surface 534 of the mobile gripping member fastening arm 216. A top surface 536 of the plate 126 supports a bottom surface 538 of the fastening arm 216.

Figure 6:
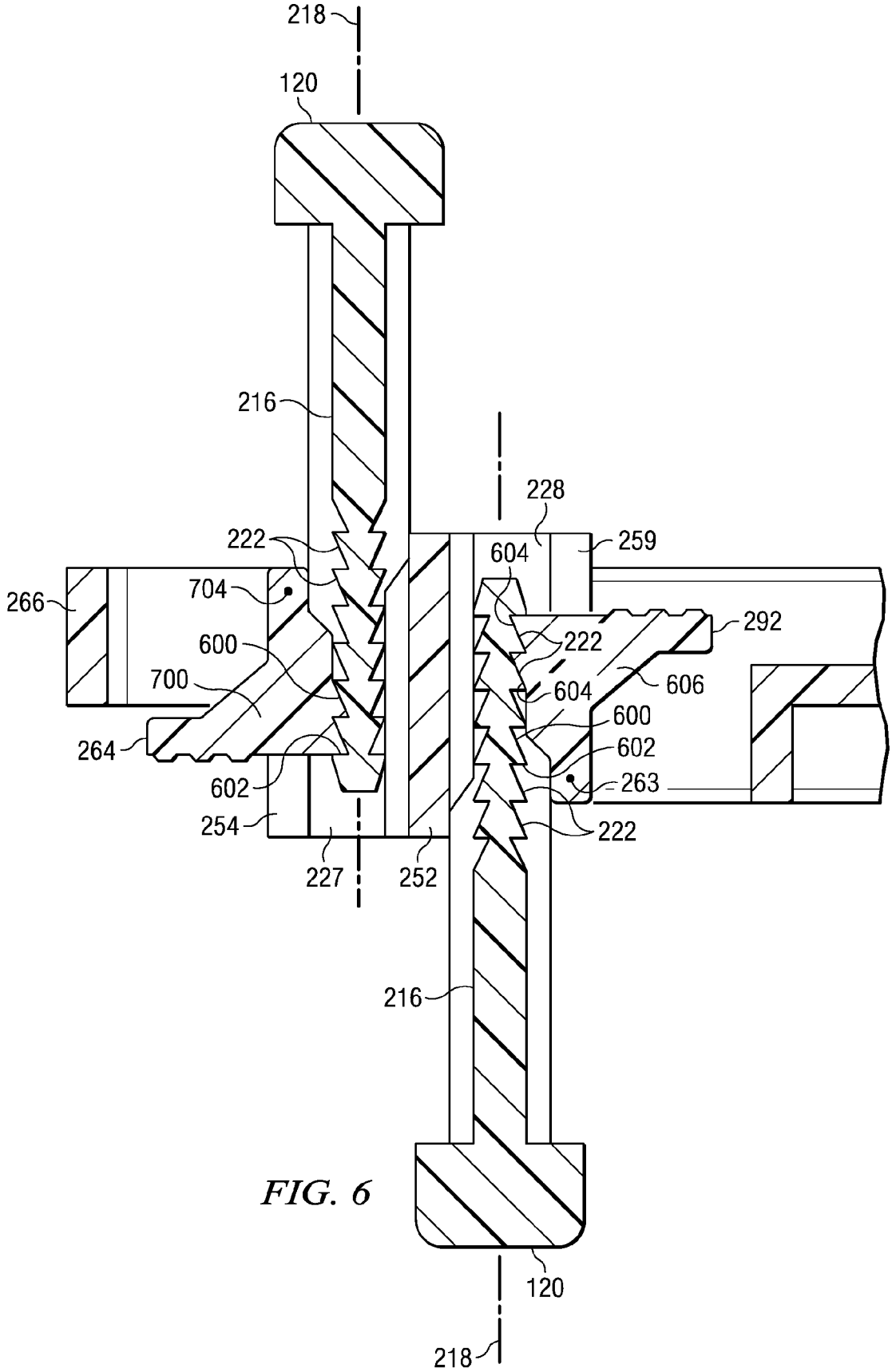
FIG. 6 is a sectional detail taken through two pairs of stationary and mobile gripping members in the condition tha they appear in FIG. 4.

FIG. 6 shows a sectional view through two mobile gripping members 120 as inserted into respective adjacent channels or orifices 227, 228 to a closed, fastened or detented position therein. As shown, it is preferred that the teeth 222 have a "shark tooth" design, where each of the leading surfaces 600 is an inclined plane, and each of the trailing surfaces 602 takes a steeper angle to the direction of translation or insertion 218. This will make withdrawal of the mobile gripping members 120 from the orifices 227, 228 much more difficult than their insertion.

For each mobile gripping member 120, at least one, and preferably two, teeth 604 of a pawl 606 engage with two teeth 222 of the fastening arm 216 to prevent the mobile gripping member 120 from being withdrawn. Rails 224 (see FIGS. 2A and 2B) and teeth 222 have been formed on both sides of fastening arm 216, even where only one side thereof engages with pawl 606. This intentional duplication permits the same mobile gripping member 120 to be used with any channel 227-230, pairs of which are formed in mirror image to each other. The teeth of pawl 700, associated with channel 227, are similarly engaged with the teeth 222 of another mobile gripping member 120.

Figure 7:
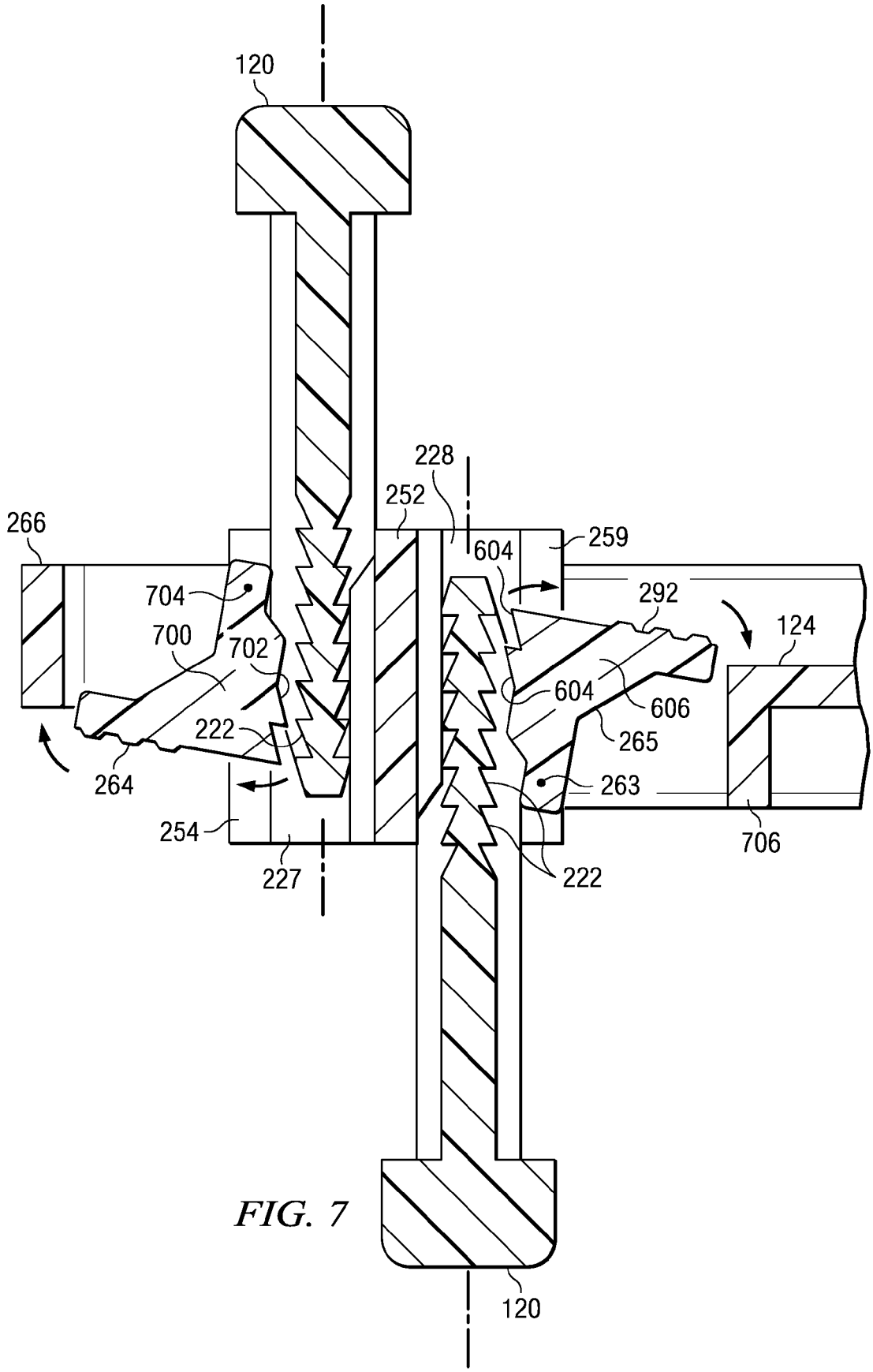
FIG. 7 is a sectional detail of the same structure shown in FIG. 6, showing deflection of pawls and levers to positions at which each of a pair of mobile gripping members may be released.

FIG. 7 is a detail of the same region as that shown in FIG. 6, but illustrates the deformation of pawl 606 when tab 292 is pushed inward (in this FIGURE, downward) with sufficient force. The slots 261 (FIG. 2A) turn a remaining, unslotted portion 263 of front plate 259 into a hinge or torsion bar. Because of the triangular gusset 265 and the slots 261 (FIG. 3), the combined pawl/lever structure 292/606 will rotate as a unit approximately around the pivot 263 in until teeth 604 have been rotated up and out of the way of fastening arm teeth 222. In this condition, the mobile gripping member 120 may be withdrawn from channel 228 (in this FIGURE, downwardly) and the hanger 100 detached from the articles 102, 104 it is suspending. The adjacent channel 227 is equipped, in mirror image, with a pawl 700 having teeth 702 that interact with teeth 222 of another mobile gripping member 120. The pawl 700, integral with the tab 264, rotates around a hinge or pivot 704 upon the application of sufficient force (in this FIGURE, upward) and disengages pawl teeth 702 from teeth 222 of the inserted mobile gripping member 120. Guard 266 can be used as a fulcrum or purchase point of the hand while actuating lever 264; vertical structural member 124 can be used as a fulcrum or purchase point for the hand while actuating lever 292. In the illustrated embodiment, a raised ridge 706 may aid in this fulcrum leveraging or purchase point function.

Figure 8:
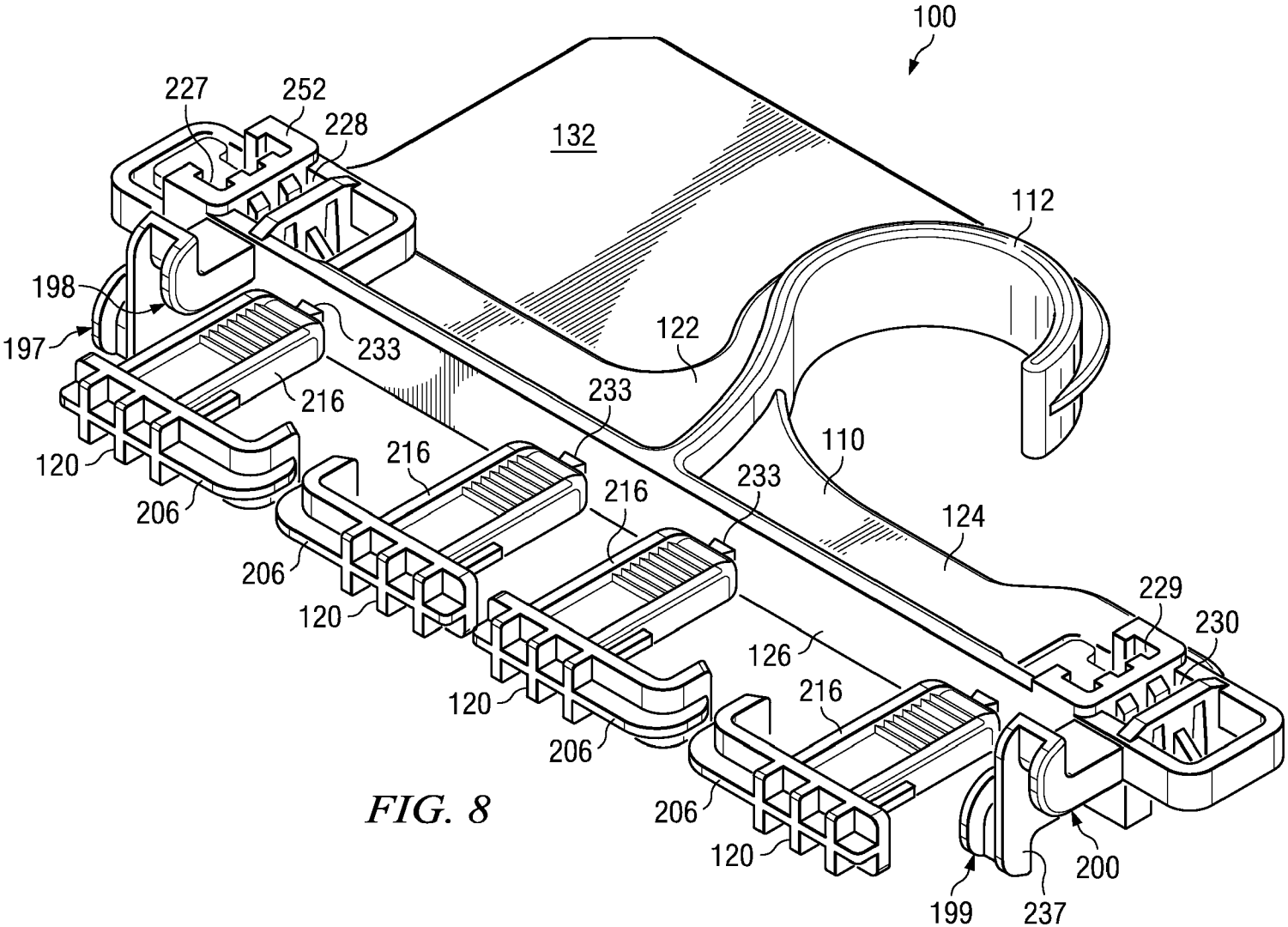
FIG. 8 is an isometric view of the hanger shown in FIG. 1, after injection-molding but before detachment of the mobile gripping members.
Figure 9:
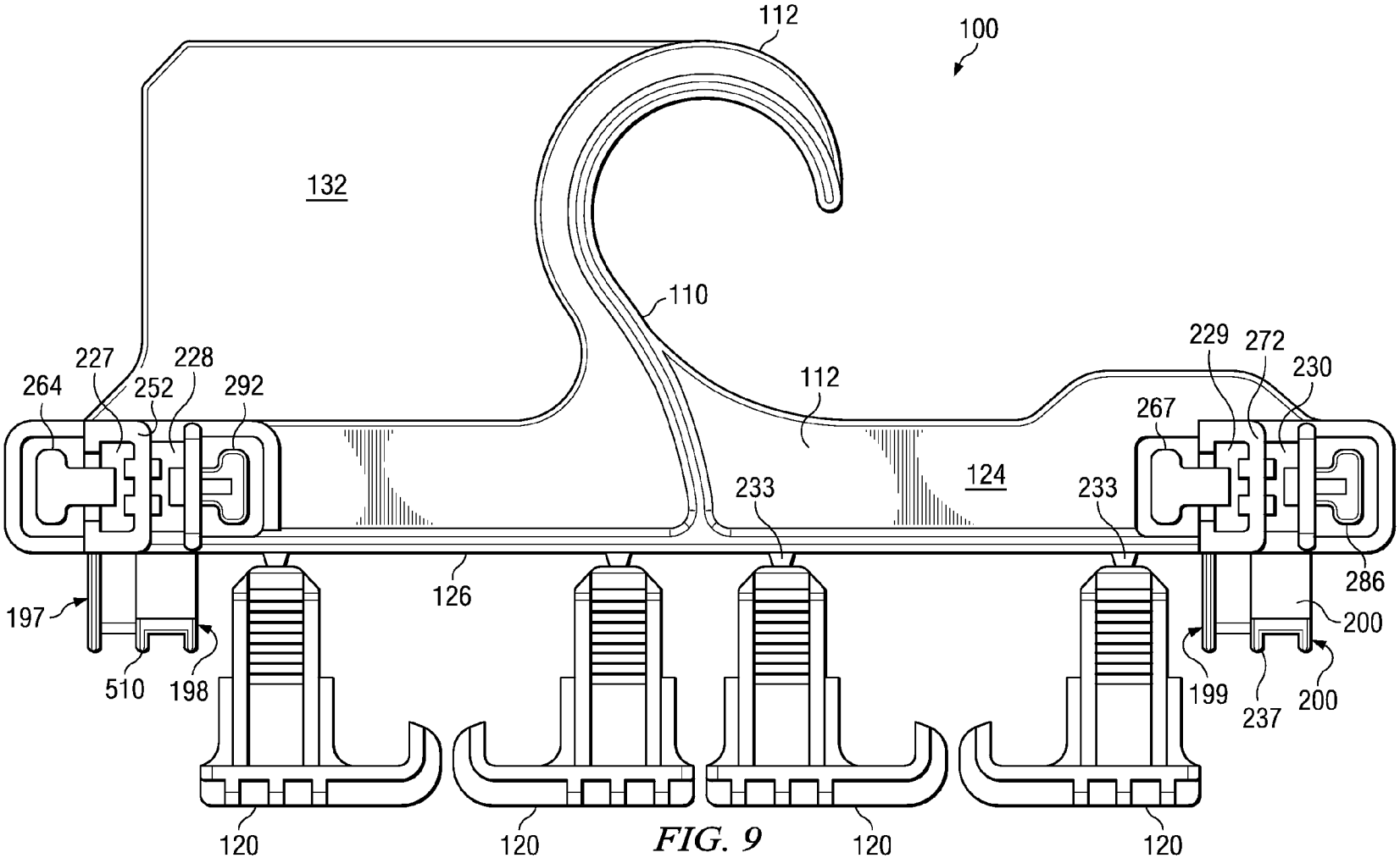
FIG. 9 is a plan view of the hanger in the condition it is shown in FIG. 8.

FIG. 8 is an isometric view of the hanger 100 as it appears out of the mold and prior to use. Preferably, the mobile fingers 120 are molded as a unit with hanger body 110. In general, it is preferred that the depth of this mold (in a direction orthogonal to plate 124) be minimized. This is aided by specifying vertical ratchet surfaces on the fastening arms 216, as this orientation will produce a flatter profile of the entire mold. A single reinforcing plate 206 on the mobile gripping members 120 is preferably chosen instead of e.g., two or three such plates or processes 238, 237, 239 for stationary gripping pair 197, 198 (see FIG. 3A). This is done for ease in molding, as it obviates any need for a side action in the mold. The beveled noses 233 of the fastening arms 216 make convenient points to detach the mobile gripping members 120 from the hanger body 110. FIG. 9 is a plan view of the hanger 100 in this condition.

The present invention extends to embodiments other than those illustrated. As mentioned, the number of pairs of stationary gripping members 197, 198; 199, 200 can instead be selected as one or three or more, depending on the nature of the article to be suspended.

The illustrated fastening arms 216 take a vertical orientation, but the ratcheting or detenting surfaces thereof alternatively could be horizontal or at some other angle to the vertical. While fastening arms have been shown as integral with the mobile gripping members and the pawls and channels 227-230 are shown associated with the stationary gripping members, these structures could be reversed, such that the mobile gripping members have the channels and pawls and the stationary gripping members have horizontally projecting fastening arms. While it is preferred that the pawl 606 have two teeth 604 and the fastening arms 216 have multiple teeth 222, minimally all that is required is one detent on the fastening arm which would cooperate with one such pawl detent, tooth, catch or latch in the channel 228 to define and retain a closed or fastened position. And while the present invention has particular application to vehicle floor mats, it also has application to the suspension of pairs of any other article, particularly heavy ones, which may be advantageously displayed or stored using a hanger.

In summary, a novel article hanger has been shown and described which captures the articles to be suspended by inserting mobile gripping members or claws along channels to close with respective stationary gripping members or claws. The stationary gripping members are arranged as closely adjacent pairs so that they share a plate that forms a portion of each. Provision of teeth on fastening arms in cooperation with a pawl prevents inadvertent detachment of the hanger from the articles. Channels or orifices for fastening arms of the mobile gripping members are also arranged in closely adjacent pairs so as to share a structural back plate making up each such channel.

While illustrated embodiments of the present invention have been described and illustrated in the appended drawings, the present invention is not limited thereto but only by the scope and spirit of the appended claims.

I claim:

1. A hanger for suspending a plurality of articles, comprising:

a body;

at least first and second pairs of opposed article gripping members, one of each said pair being a stationary article gripping member affixed to the body to laterally outwardly extend therefrom;

the other of each said pair of article gripping members being a mobile article gripping member translatable toward the stationary gripping member to fasten at least one article therebetween;

the stationary article gripping members in the first and second pairs of article gripping members being formed to be adjacent to each other, a first of the stationary article gripping members extending in a first lateral direction from the body, a second of the stationary article gripping members extending in a second lateral direction from the body in mirror image to the first direction;

each of said stationary article gripping members being formed as a channel defined by first, second and third plates, the first plate being vertical and in a plane parallel to the first direction, the second plate being joined to and extending from the first plate in a third direction orthogonal to the first and second directions, the third plate being joined to the second plate, the third plate disposed to be vertical and in a plane parallel to the first direction and spaced from the first plate by the second plate, the third plate of one of said stationary article gripping members being continuous and coplanar with the third plate of the other of said stationary article gripping members;

a first one of the mobile article gripping member and the stationary article gripping member in each pair having a fastening arm extending in parallel to the first direction toward a second one of the mobile article gripping member and the stationary gripping member, the fastening arm having formed therein a plurality of detenting teeth spaced apart from each other in the first direction; and the second one of the mobile article gripping member and the stationary article gripping member in each pair having an arm-receiving channel and a movable pawl for engaging at least a selected one of the detenting teeth on said fastening arm, a lever operatively connected to the pawl for selectively disengaging the pawl from the detenting teeth.

2. The hanger of claim 1, wherein the first and second pairs of gripping members are formed at a first location, third and fourth pairs of gripping members disposed at a second location spaced from the first location.

3. The hanger of claim 1, wherein the stationary gripping member is integrally molded with the body of the hanger.

4. The hanger of claim 1, wherein the body of the hanger has a width and height which are much greater than a depth thereof, the body of the hanger and the mobile gripping member injection-molded of plastic in a single mold, the mobile gripping member detached after molding for fastening the hanger to the article.

5. The hanger of claim 1, wherein both the stationary gripping member and the mobile gripping member have article support fingers extending in parallel to the first direction, the article support fingers extending toward each other.

6. The hanger of claim 1, wherein the teeth of the fastening arm are formed in a surface which in use is vertically oriented.

7. The hanger of claim 1, wherein the pawl engages at least two teeth on the fastening arm.

8. The hanger of claim 1, wherein the first and second directions are horizontal and 180 degrees apart from each other.

9. The hanger of claim 1, wherein at least two articles are suspended by each pair of stationary and mobile article gripping members.

10. A hanger for suspending a plurality of articles, comprising:

a body;

at least four downwardly depending article gripping members, two of said gripping members being stationary article gripping members affixed to the body to downwardly depend therefrom;

two of said gripping members being separate mobile article gripping members each linearly translatable in parallel to an axis of translation at an angle to the vertical and toward a respective stationary gripping member to fasten an article therebetween;

each mobile article gripping member having a fastening arm extending parallel to the axis of translation toward the body of the hanger, the fastening arm having formed thereon at least one detent; and first and second arm-receiving channels formed in the body to be adjacent to each other and receiving respective ones of the fastening arms of the mobile gripping members, a movable latch associated with each arm-receiving channel for engaging the detent on said fastening arm to fasten the article between the two gripping members, a lever operatively connected to the latch for selectively disengaging the latch from the detent in order to release the article from the hanger, a common plate of the body forming portions of both the arm-receiving channels.

11. The hanger of claim 10, wherein the lever disposed on an end of the body and pressable by a thumb or finger of the human hand in a second direction to disengage the latch from the detent on the fastening arm, a guard formed on the body to extend around the lever in a plane at an angle to the second direction, the guard protecting the lever from inadvertent actuation and affording an anchor or purchase point to the human hand in operating the lever.

12. The hanger of claim 10, wherein the fastening arm of each mobile gripping member has a stop formed thereon which physically interferes with a respective arm-receiving channel, thereby limiting the depth by which the fastening arm may be inserted into the channel.

* * * * *